United States Patent [19]

Birch

[11] Patent Number: 4,915,317

[45] Date of Patent: Apr. 10, 1990

[54] WEB WINDING APPARATUS HAVING AN AUTOMATIC CHAIN CUTTER TENSIONER AND RELATED METHOD

[75] Inventor: Steven W. Birch, Monroe, N.C.

[73] Assignee: Birch Brothers Southern, Waxhaw, N.C.

[21] Appl. No.: 310,691

[22] Filed: Feb. 15, 1989

[51] Int. Cl.[4] ..... B26D 1/48; B65H 19/26

[52] U.S. Cl. ..... 242/56 R; 83/819

[58] Field of Search ..... 242/56 R, 56.6; 83/816, 83/819; 474/113, 114

[56] References Cited

U.S. PATENT DOCUMENTS

| | | | |
|---|---|---|---|
| 920,035 | 4/1909 | Dittbenner | 83/818 |
| 2,644,492 | 7/1953 | Crane | 83/819 |
| 3,047,248 | 7/1962 | Birch, Jr. et al. | 242/56 R |
| 3,049,311 | 8/1962 | Birch, Jr. | 242/56 R |
| 3,167,268 | 1/1965 | Birch et al. | 242/56 R |
| 3,199,393 | 8/1965 | Birch | 242/56 R X |
| 3,485,121 | 12/1969 | Birch | 242/56 R X |
| 3,778,963 | 12/1973 | Straujups et al. | 242/66 |
| 3,845,914 | 11/1974 | Straujups | 242/56 R |
| 4,000,863 | 1/1977 | Straujups | 242/56 R |
| 4,128,212 | 12/1978 | Birch | 242/56 R |
| 4,475,696 | 10/1984 | Birch et al. | 242/66 |
| 4,708,695 | 11/1987 | Sugiyama | 474/113 X |

FOREIGN PATENT DOCUMENTS

| | | | |
|---|---|---|---|
| 2320169 | 3/1977 | France | 83/819 |
| 596436 | 3/1978 | U.S.S.R. | 83/819 |

*Primary Examiner*—Joseph J. Hail, III

*Attorney, Agent, or Firm*—Bell, Seltzer, Park and Gibson

[57] ABSTRACT

A winding apparatus for web material with severing device comprising a pair of power driven endless cutter chains wherein the tension of the cutter chains is adjusted during operation of the winding apparatus and thereby avoids the need for periodic manual adjustment and the problems attendant thereto. The device for adjusting the tension comprises a force applying fluid cylinder to move one of the sprockets carrying each chain to a position which increases the tension. A cooperating latch device serves to secure the sprocket in any adjusted position.

15 Claims, 3 Drawing Sheets

Fig. 4

WEB WINDING APPARATUS HAVING AN AUTOMATIC CHAIN CUTTER TENSIONER AND RELATED METHOD

BACKGROUND OF THE INVENTION

Web materials of various types have heretofore been wound into successive rolls by using apparatus which supports the roll of web material until the roll reaches a final size at which time the web is severed and a new roll is formed. Examples of such devices include U.S. Pat. Nos. 3,199,393, 3,485,121, 4,000,863 and 4,475,696 which are commonly owned with the present invention. For many thin and non fibrous webs, such as foam and paper, a relatively simple serrated blade cutter, such as shown in U.S. Pat. No. 4,475,696, will quickly and easily cut through the web in a uniform cross cut. However, for thicker or fibrous webs, the serrated blade tends to shred the web and not provide a clean cut.

To cut these thicker or fibrous types of webs, a severing device including power driven endless cutter chain was developed to provide an instantaneous cross cut. As explained in detail in U.S. Pat. Nos. 3,199,393, 3,485,121 and 4,000,863, the cutter chain includes a series of spaced apart sharp cutting elements which shear through the web when the severing device is raised into and through the path of the web. Such severing devices have been very successful in providing a clean, virtually instantaneous cut in the web. However, in the process of cutting and forming a series of successive rolls, the cutter chain will stretch and increase in length over time. Presently, the operator must stop the winding machine and manually tighten the chain typically by repositioning a cutter chain sprocket.

In many operations, the winding machine is operated continuously, twenty-four hours a day. Shutting down the winding machine for such an adjustment can be very expensive and typically takes several hours before the service man may get to and complete the adjustment. As a result, some operators have put off adjusting the slack in the chain until the chain has sagged to such a degree as to engage underlying portions of the winding machine destroying the chain and other equipment on the winding machine.

Accordingly, it is an object of the present invention to provide means to adjust the tension of the cutter chain during operation of the winding machine and thus maintain the chain from becoming unduly slack so as to avoid the need for manual adjustment and to thereby avoid the disadvantages of the prior art as discussed above.

It is a further object of the present invention to provide means for incrementally adjusting the tension of the cutter chain as the same stretches and increases in length during operation of the winding machine.

It is a further object of the present invention to provide a process of operating a winding apparatus so as to prevent an unduly slack cutter chain by adjusting the tension of the same during operation of the winding apparatus.

SUMMARY OF THE INVENTION

The above and other objects of the invention are accomplished by the provision of an apparatus comprising a winding station for winding a roll of web material onto an elongate core to a desired roll size. The apparatus further comprises severing means positioned adjacent said winding station and being actuated for transversely cutting the web in response to the roll attaining a desired roll size. The severing means comprises endless cutter chain means and means operatively associated with the endless cutter chain means for adjusting the tension of the same during winding of successive rolls.

The method of operating a winding apparatus comprises successively winding web material into a roll to form a desired roll size. The web is transversely severed so as to permit starting of a new roll by moving an endless cutter chain into engagement with the web material. The tension of the chain is adjusted during winding of successive rolls of web material so as to prevent the cutter chain from becoming unduly slack from successive severing steps during winding of successive rolls.

BRIEF DESCRIPTION OF THE DRAWINGS

Some of the objects of the invention have been stated and other objects will appear as the description proceeds when taken in conjunction with the accompanying drawings in which.

DETAILED DESCRIPTION OF THE PREFERRED EMBODIMENT

Figure 1:
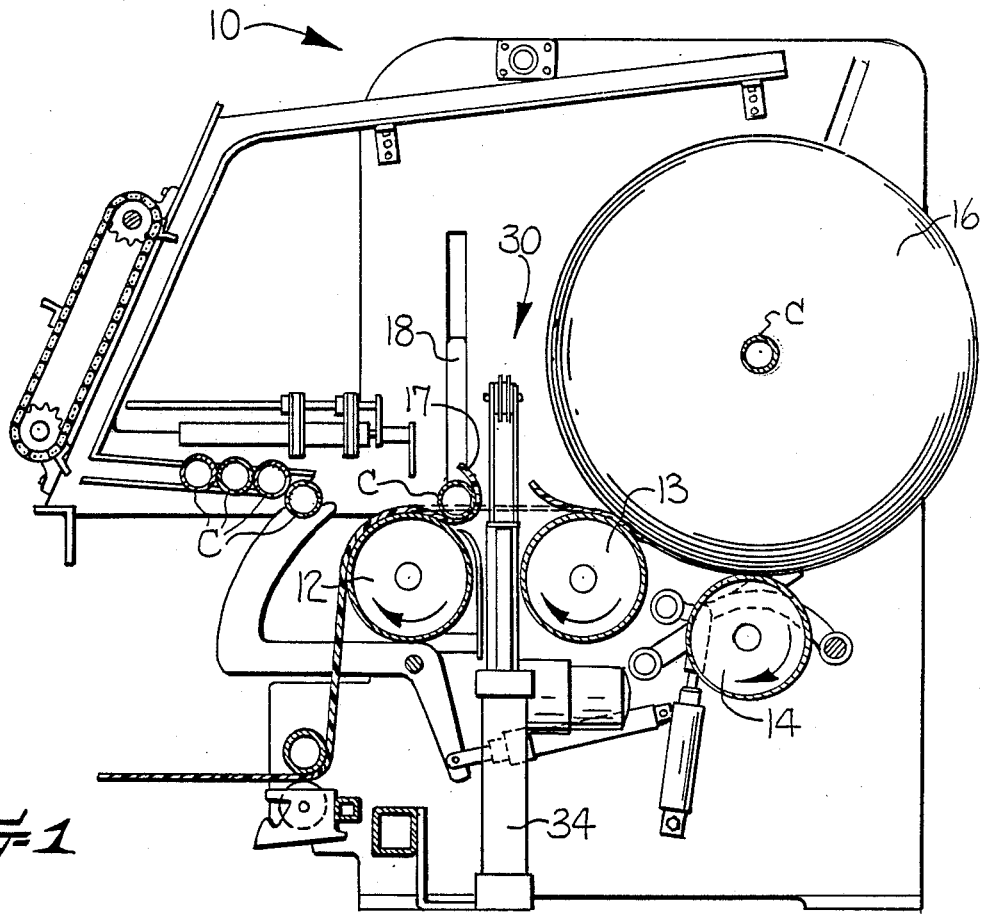
FIG. 1 is a side elevation view of a winding apparatus incorporating the features of the present invention.
Figure 7:
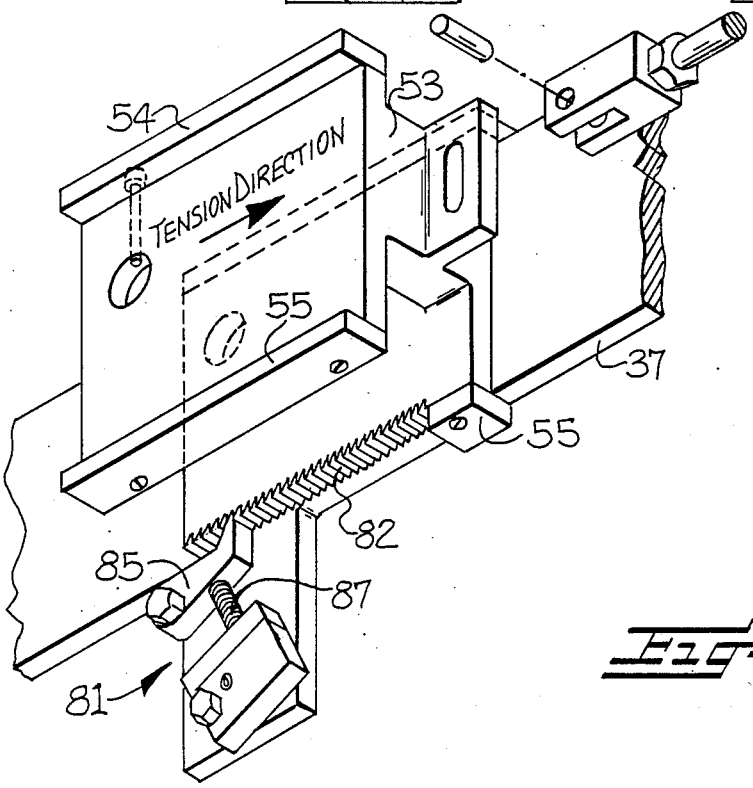
FIG. 7 is an enlarged fragmentary bottom perspective view of the severing apparatus particularly illustrating the latch means.

Referring, now more particularly to the drawings, FIG. 1 illustrates a two stage winding machine, generally indicated by the numeral 10, for winding long lengths of a web material W onto cores C. The web material W is directed into the winding machine 10 from the left side of the figure over a series of power rollers 12, 13 and 14 to a roll 16. The roll 16 is positioned in the second station of the winding machine which is generally on top of the power rollers 13 and 14 and as illustrated has achieved a predetermined final size. The predetermined final size may be determined by a variety of measurements or factors such as the weight of the roll, length of the material on the core, or the diameter of the roll. At such time that the roll reaches the final size, a severing apparatus generally indicated by the numeral 30, is raised up and through the web material W to transversely sever the web material W and start a new roll. The leading end 17 of the incoming web material W is directed around a core C positioned at the first station of the winding machine 10 which is generally on top of power roller 12. The core on which the new roll is wound is held in the first station by arms 18 until it attains a predetermined initial size. While the new roll is being wound at the first station, the roll 16 is doffed off the winding machine 10 to clear the second station for the next successive roll. Once the new roll achieves the predetermined initial size, it is moved into the second station to continue winding. This process continues so as to wind many successive rolls. For a more detailed explanation of the operation of two stage winding machines, refer to commonly owned U.S. Pat. Nos. 3,049,311, 3,778,963, 4,000,863 and 4,475,696.

Figures 2, 6:
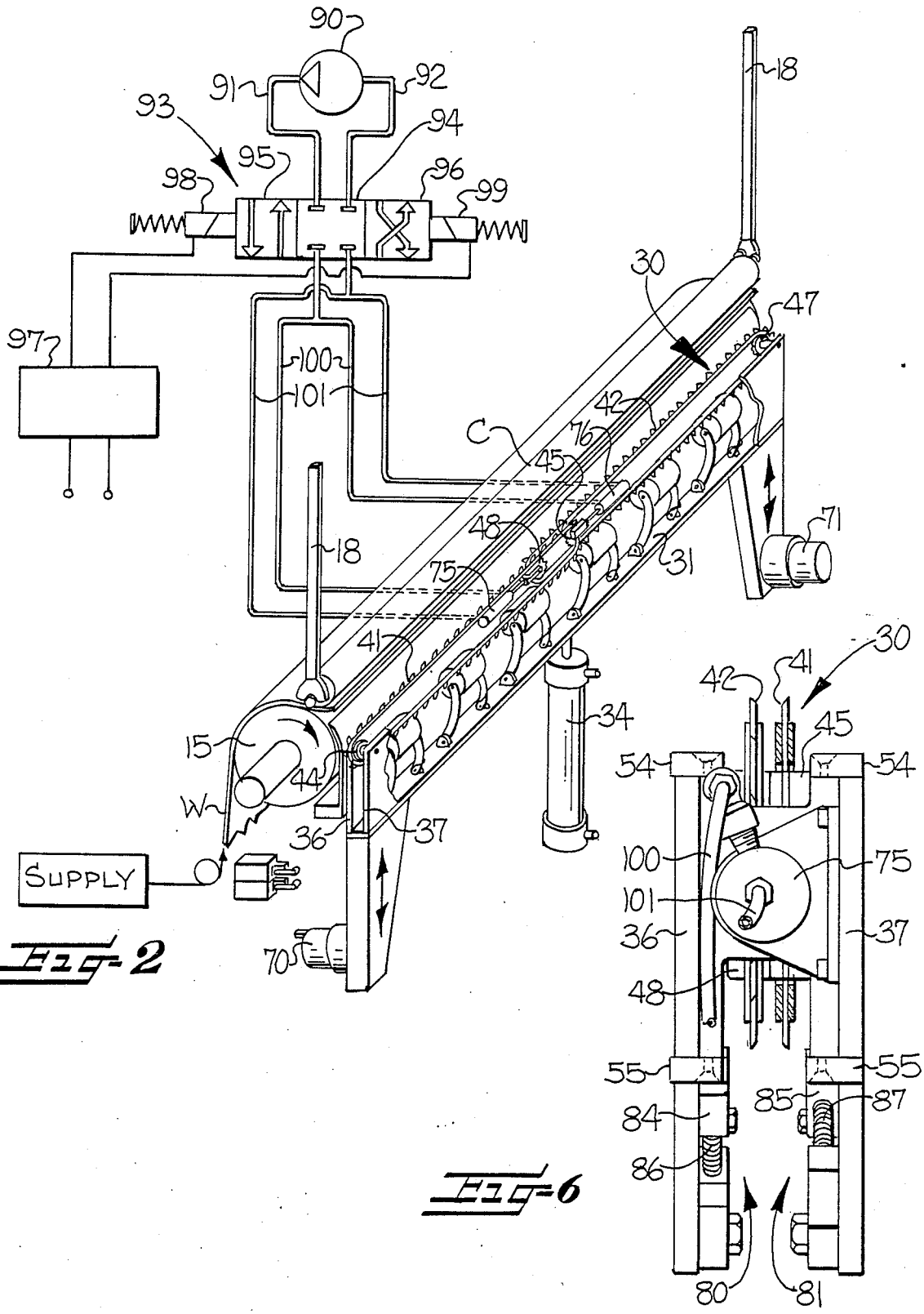
FIG. 2 is a perspective view of a preferred embodiment of the severing apparatus.
FIG. 6 is a cross section view taken along line 6—6 in FIG. 5.

Focusing more particularly on the severing apparatus 30, as seen in FIG. 1, the severing apparatus 30 is positioned between the first and second stations of the winding machine 10 and is mounted for vertical reciprocable movement. Referring now to FIG. 2, the severing apparatus comprises an elongate frame 31 which is connected to a fluid powered cylinder 34. The fluid powered cylinder 34 raises the severing apparatus 30 up to sever the web. The frame 31 comprises spaced apart rails 36 and 37 between which are mounted a pair of overlapping power driven endless cutting chains 41 and 42. The chains are offset slightly from one another in the space between the rails 36 and 37 and have overlapping inner ends and distally positioned outer ends.

The endless cutting chains 41 and 42 are engaged and supportingly carried by spaced apart pairs of sprockets 44, 45, 47 and 48 which are supported by the frame 31. The outer sprockets 44 and 47 are rotatably supported in a fixed position at distal ends of the frame 31. The inner end sprockets 45 and 48 are rotatably mounted for sliding movement on said rails 36 and 37 toward and away from the ends of the elongate frame 31.

FIGS. 3–7 provide a more detailed illustration of the inner end sprockets 45 and 48, and the means for slidingly supporting the sprockets. The inner sprockets 45 and 48 are rotatably mounted in a fixed position on clevis shaped connectors 52 and 53. The connectors 52 and 53 are carried by the rails 36 and 37 for horizontal sliding movement along the length of the frame 31. The connectors 52 and 53 include upper and lower flanges 54 and 55 extending laterally outward to engage and slide along upper and lower surfaces of the rails 36 and 37. The inner sprockets 45 and 48 are rotatably supported in a fixed position on the connectors 52 and 53.

Figures 3, 4, 5:
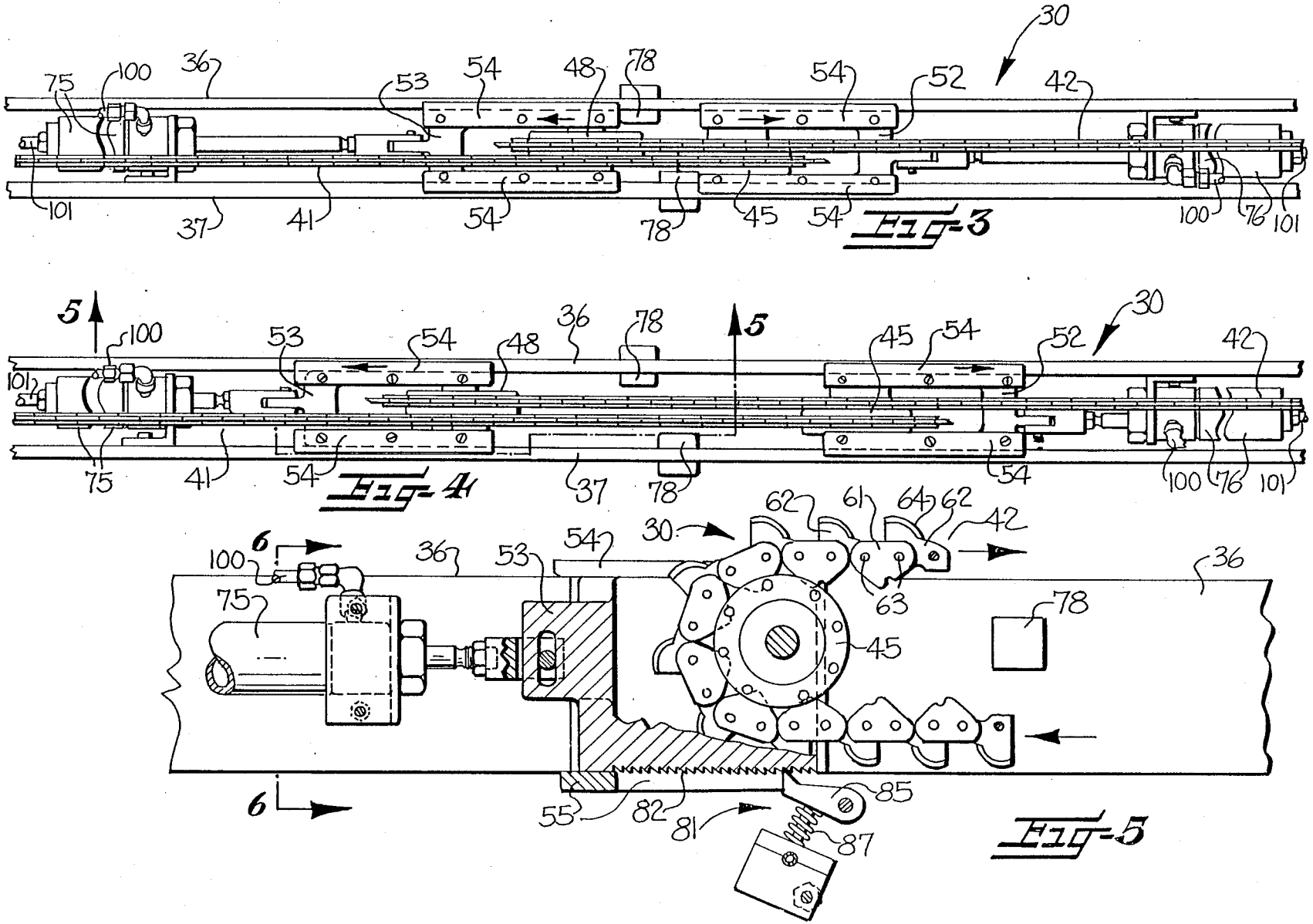
FIG. 3 is an enlarged top fragmentary view of the severing apparatus illustrating the fully extended positions of the connectors.
FIG. 4 is an enlarged top fragmentary view similar to FIG. 3 particularly illustrating the fully retracted positions of the connectors.
FIG. 5 is an enlarged fragmentary cross section view taken along line 5—5 of FIG. 4.

The sprockets, as already discussed, are arranged in cooperating pairs to engage and supportingly carry each endless cutting chain. The endless cutting chains 41 and 42, as best seen in FIG. 5, are comprised of hardened steel links 61 and 62, riveted together by rivets 63. The links 62 include a sharpened cutting edge 63 which is disposed upwardly toward the web in the upper run of the endless chain. The upper run of the chain is positioned to extend above the rails 36 and 37 while the remaining portions, including the sprockets, are positioned between the rails and generally below the upper surfaces thereof. The chains 41 and 42 are moved or rotated by motors 70 and 71 and in the preferred arrangement rotate in opposite directions so that the web is cut from the middle outwardly to the outer peripheral edges of the web. The motors 70 and 71 are preferably of the high speed low torque variety and are conventionally to operate only at the time the web is to be severed. This saves wear and tear on the motor and chains, particularly when the cycle time of the successive wound rolls is of long duration.

During the successive use of the winding apparatus, the links 61 and 62 in the chain stretch and increase in length over a period of time. The chain then will sag and flex uncontrollably during use and the tension of the chain has to be adjusted. To adjust the tension in the chain, fluid cylinders 75 and 76 are connected one each to the connectors 52 and 53 to move the inner sprockets 45 and 48 further away from the respective end sprockets 44 and 47 to increase the tension on the chains. The fluid cylinders 75 and 76 are positioned so as to extend lengthwise between the upper and lower runs of the power driven chains to move the connectors 52 and 53. The range of movement o the connectors by the cylinders 75 and 76 is best illustrated in FIGS. 3 and 4. Blocks 78 which are fixed to the rails 36 and 37 limit the extent to which the connectors may move toward each other in the tension relieving direction.

The tension applied to the chains must be sufficient to take the slack out of the chain but not so tight as to increase the rotating resistance of the sprockets and prevent the motor from being able to start the movement of the chain. In the preferred arrangement, the fluid cylinders 75 and 76 adjust the tension by pulling the respective connectors 52 and 53 under controlled pressure while the chain is at rest during operation of the winding machine. To aid in lockingly maintaining the chains in their adjusted positions latch means 80 and 81 are provided in cooperation with each of the fluid cylinders 75 and 76. The latch means 80 comprises a rack 82, preferably disposed along a lower surface of the connector 52. A pawl 84 is attached to the rail 36 to engage the rack 82. Similarly, latch means 81 comprises a rack 83 along the lower surface of connector 53 and a pawl 85 attached to the rail 37 to engage the rack 83. The pawls 84 and 85 are spring biased by springs 86 and 87 toward the racks 82 and 83 to therefore resist movement of the connector that would slacken the chain.

In use, the fluid cylinders 75 and 76 are preferably powered by an air compressor 90, FIG. 2. As schematically illustrated the air compressor 90 has a high pressure line 91 and a low pressure return line 92 leading pressure line 91 and a low pressure return line 92 leading to a control valve generally indicated by the number 93. The control valve 93 is a conventional slide valve having solenoids 98 and 99 for moving the valve laterally in response to signals from a control means 97. The slide valve has three positions 94, 95, and 96. The position 94 is a lock position for the cylinders 75 and 76 not permitting air in or out of the chambers or either side of the piston. The left position 95 provides pressure through line 100 to pull the connectors 52 and 53 and increase the tension on the chains. The right position 96, provides pressure through line 101 to push the connectors and release the tension on the chains to permit replacement of the chain.

The operation of the control system for adjusting the tension on the chain may be arranged in a variety of ways. The fluid cylinders may be operated to continuously exert tension on the chain or may intermittently adjust the chain between severing operations. The adjustment of the tension may also be delayed for periods of time and set to adjust the tension in response to a timer. The control system may also be responsive to other signals such as a sensor sensing slackness in the chain.

In the drawings and specification there has been set forth a preferred embodiment of the invention, and although specific terms are employed, they are used in a generic and descriptive sense only and not for purposes of limitation.

That which is claimed is:

1. A method of winding a web material into successively wound rolls comprising the steps of: successively winding the web material into rolls of a desired roll size, transversely severing the web between successive rolls by moving an endless cutter chain into engagement with the web material, adjusting the tension of the endless cutter chain during winding of successive rolls of web material so as to prevent the cutter chain from becoming unduly slack from successive severing steps during the winding of successive rolls, and lockingly maintaining the cutter chain in its adjusted state through use of a mechanical latch means.

2. A method of winding a web material into successively wound rolls comprising the steps of: winding the web material onto a roll at a first winding station to form a predetermined initial size roll, moving the initial size roll to a second winding station and winding the roll at the second station to a predetermined larger final roll size, transversely severing the web by moving an endless cutter chain into engagement with the web material, repeating all of the foregoing steps so as to obtain successively wound rolls of web material, adjusting the tension of the endless cutter chain during winding of successive rolls of web material so as to prevent the cutter chain from becoming unduly slack from successive severing steps during the winding of successive rolls, and lockingly maintaining the cutter chain in its adjusted state through use of a mechanical latch means.

3. An apparatus for receiving a web material and successively winding rolls of the web material onto elongate cores, the apparatus comprising: a winding station for winding a roll of web material on a core to a desired size, and severing means positioned adjacent said winding station and being actuated for transversely cutting the web upon the roll attaining a desired roll size, said severing means comprising endless cutter chain means, means operatively associated with said endless cutter chain means for adjusting the tension of the same during winding of successive rolls of the web material so as to prevent the cutter chain means from otherwise becoming unduly slack from successive severing operations during the winding of successive rolls, and means for lockingly maintaining the cutter chain in its adjusted position during winding.

4. The apparatus according to claim 3 wherein said endless cutter chain means comprises a pair of endless cutter chains arranged in substantially parallel relation with overlapping inner ends and outer ends distally positioned from each other.

5. The apparatus according to claim 4 wherein said pair of endless cutter chains rotate in opposite directions to cut the web from the center of the web to the outward edges of the web.

6. The apparatus according to claim 3 further comprising a plurality of sprockets supportingly carrying said endless cutter chain means and wherein said means for adjusting the tension of said endless cutter chain means comprises force applying means operatively associated with one of said sprockets to move said one sprocket to a position which increases the tension of said endless cutter chain means.

7. The apparatus according to claim 6 wherein said means for lockingly maintaining the cutter chain includes latch means operatively associated with said one sprocket and cooperating with said force applying means for maintaining the said one sprocket in an adjusted position.

8. The apparatus according to claim 3 wherein said severing means further comprises an elongate frame arranged transverse to the web, and sprockets rotatably carried by said frame for engaging and supporting said endless cutter chain means.

9. The apparatus according to claim 8 wherein said endless cutter chain means comprises a pair of endless cutter chains arranged in substantially parallel relation with overlapping inner ends and outer ends distally positioned from each other, and wherein said sprockets are positioned as spaced apart cooperating pairs for engaging and supporting each respective endless cutter chain.

10. The apparatus according to claim 9 wherein said means for adjusting the tension of the cutter chain means includes force applying means operatively associated with one of said sprockets carrying each cutter chain and adapted to adjustably move such respective sprocket to a position away from the other sprocket carrying each cutter chain so as to increase the tension of each endless cutter chain.

11. An apparatus for receiving a web material and successively winding rolls of the web material onto elongate cores, the apparatus comprising: a first winding station for starting and winding a roll of web material on a core to a predetermined initial size, a second winding station spaced from said first winding station and adapted to receive the initial size roll and to wind the roll to a predetermined larger final roll size, and severing means positioned between said winding stations and being actuated for transversely cutting the web in response to the roll at the second winding station attaining a predetermined larger roll size, said severing means comprising endless cutter chain means, means operatively associated with said endless cutter chain means for adjusting the tension of the same during winding of successive rolls of the web material so as to prevent the cutter chain means from otherwise becoming unduly slack from successive severing operations during the winding of successive rolls, and means for lockingly maintaining the cutter chain in its adjusted position during winding.

12. Severing apparatus adapted for being used on a winding machine for severing web material being wound into successive rolls, said severing apparatus comprising a pair of endless cutter chains arranged in substantially parallel relation with overlapping inner ends and outer ends distally positioned from each other, said endless cutter chains being adapted to transversely sever web material starting from the middle of the web material and toward the opposite side edges of the web, a pair of first and second spaced apart sprockets cooperatively engaging and supportingly carrying each respective chain, an elongate frame supporting said sprockets for rotation thereon, said first sprockets being mounted in fixed positions on said frame, means mounting said second sprockets for sliding movement in a direction so as to increase the tension on the chain, and cutter chain tension adjusting means carried by said frame and operatively associated with each of said second sprockets for preventing the endless cutter chains from becoming unduly slack from successive use thereof, said cutter chain tension adjusting means comprising respective force applying means carried by said frame and operatively associated with respective ones of said second sprockets carrying said cutter chains and adapted to adjustably move said second sprockets to a position which increases the tension on the chain, and respective latch means carried by said frame and cooperating with a respective one of said force applying means for lockingly maintaining said second sprockets in their respective adjusted positions, wherein the adjusting and locking means are both operable during operation of the cutter chain.

13. The apparatus according to claim 12 wherein said respective force applying means for each cutter chain comprises a fluid cylinder, and connecting means for operatively connecting said fluid cylinder to one of said second sprockets.

14. The apparatus according to claim 12 wherein each of said latch means comprises a pawl and rack arranged so that the pawl is disposed to resist relative movement with said rack and thereby maintaining one of said second sprockets in its respective adjusted positions.

15. The apparatus according to claim 12 further including respective connectors slidingly supported by said elongate frame for rotatably supporting respective ones of said second sprockets, and wherein said force applying means for each of said second sprockets comprises a fluid actuated cylinder connected to said connector to adjustably move said second sprocket, and further wherein each of said latch means comprises a rack formed along an elongate surface of said connector, and a pawl fixed on said elongate frame for engaging said rack to resist movement that would reduce the tension of said cutter chain.

* * * * *